United States Patent [19]

Yang et al.

[11] Patent Number: 4,859,393

[45] Date of Patent: Aug. 22, 1989

[54] METHOD OF PREPARING POLY (P-PHENYLENETEREPHTHALAMIDE) YARNS OF IMPROVED FATIGUE RESISTANCE

[75] Inventors: Hung H. Yang; Minshon J. Chiou, both of Richmond, Va.

[73] Assignee: E. I. Du Pont de Nemours and Company, Wilmington, Del.

[21] Appl. No.: 162,967

[22] Filed: Mar. 2, 1988

[51] Int. Cl.[4] ..... D01D 5/06; D01F 6/60

[52] U.S. Cl. ..... 264/184; 264/205; 264/210.2; 264/210.7; 264/210.8; 264/211.14; 264/211.15; 264/233; 264/232; 264/340

[58] Field of Search ..... 264/184, 233, 205, 210.8, 264/211.14, 211.15, 210.2, 210.7, 232, 340

[56] References Cited

U.S. PATENT DOCUMENTS

| | | | |
|---|---|---|---|
| 3,767,756 | 10/1973 | Blades | 264/184 |
| 3,869,430 | 3/1975 | Blades | 264/184 |
| 4,048,279 | 9/1977 | Zimmerman | 264/184 |
| 4,340,559 | 7/1982 | Yang | 264/184 |
| 4,374,977 | 2/1983 | Fujiwara et al. | 264/184 |
| 4,726,922 | 2/1988 | Cochran et al. | 264/184 |

*Primary Examiner*—Hubert Lorin

[57] ABSTRACT

Poly(p-phenyleneterephthalamide) yarn of improved fatigue resistance is prepared by spinning the polymer in sulfuric acid through an air gap into an aqueous coagulating bath to produce a coagulated yarn, maintaining the coagulating bath at a temperature of at least 20° C., washing and neutralizing the yarn while it is under a tension of from 0.2 to 0.4 grams per denier, and drying the yarn at a temperature below 200° C. while it is maintained under a tension of 0.05 to 0.2 grams per denier.

3 Claims, No Drawings

METHOD OF PREPARING POLY (P-PHENYLENETEREPHTHALAMIDE) YARNS OF IMPROVED FATIGUE RESISTANCE

BACKGROUND OF THE INVENTION

A process for production of high strength, as-spun fiber from optically anisotropic dopes of poly(p-phenyleneterephthalamide) is taught in Blades U.S. Pat. No. 3,767,756. The desirability of improving the fatigue resistance of the filaments produced by the Blades' process was noted in the prior art, e.g., U.S. Pat. No. 4,374,977, and various procedures are disclosed therein purporting to yield fiber with excellent fatigue resistance. An objective of the present invention is the attainment of fiber with superior fatigue resistance to those described in said Blades patent and preferably with only simple process modification.

SUMMARY OF THE INVENTION

This invention provides novel poly(p-phenylene terephthalate) yarn of improved fatigue resistance having an apparent crystallite size in the range of 40 to 50 A, an orientation angle in the range of 20° to 30°, an elongation in the range of 4.5 to 5.6%, a tenacity of at least 18 grams per denier and a modulus of at least 200 grams per denier and less than 450 grams per denier and a process for preparing it. In the process where a solution of from 17 to 20 wt. % of the polymer in 98 to 102% $H_2SO_4$ is spun through an air gap into a coagulating bath at a temperature of at least about 20° C., but not greater than 40° C., and removed from the bath, the improvement consists of washing the yarn and neutralizing the acid therein while the fiber is under a tension in the range of 0.2 to 0.4 grams per denier and then drying the yarn at a temperature below 200° C., preferably in the range of 100° C. to 200° C. under a tension in the range of from 0.05 to 0.2 grams per denier.

DETAILED DESCRIPTION OF THE INVENTION

In accordance with the present invention, a spin dope of poly(p-phenyleneterephthalamide), referred to herein as PPD-T, having an inherent viscosity of at least 4.0 measured as described below, is prepared in concentrated sulfuric acid (98 to 102% $H_2SO_4$) to provide a concentration between 17 and 20% by wt. of the polymer. The dope is spun following the general procedures of U.S. Pat. No. 3,767,756 through an air gap (1 to 30 mm. thick) and into an aqueous coagulating bath containing from 0 to 10% by weight of sulfuric acid maintained at about 20° to about 40° C.

Quench bath temperatures can vary over quite a range, e.g., from room temperature up to about 40° C. Room temperature is generally in the range of just below 20° up to 30° C. There is a strong preference for working at the lower end of this range. The effects of this invention become more pronounced as this temperature increases, but simultaneously corrosion by sulfuric acid increases and mechanical quality of the yarn produced diminishes. Above 40° C., filament and yarn breakage during production become commercially unattractive.

Upon withdrawal from the coagulating bath, the yarn is washed and neutralized with dilute sodium hydroxide as taught in U.S. Pat. No. 4,048,279 while the yarn is under a tension of from 0.2 to 0.4 grams per denier (gpd.). Washing and neutralization can be done in stages. The yarn is then dried at a temperature of below 200° C., preferably between 100° C. and 200° C., while it is maintained under a tension of 0.05 to 0.2 gpd. Contact drying on a heated surface is preferred, e.g., over an internally heated drying roll. The specified drying temperature is that of the heating surface and the tension is that at which the yarn is fed onto the heated surface. The moisture content is reduced to from 8 to 12% by wt.

Tension on the yarn during drying is generally as low as it can be and still maintain continuity of operation on the drying rolls. Such tension is normally at or below 0.2 g/den (0.18 g/dtex).

The resulting yarn filaments exhibit an apparent crystallite size (ACS) in the range of 40 to 50 A and an orientation angle (OA) of from 20° to 30°, as measured in accordance with the procedures described in U.S. Pat. No. 3,869,429. The yarn has an elongation of from 4.5 to 5.6%, a tenacity of at least 18 gpd., and a modulus of at least 200 gpd. and less than 450 gpd., all as measured in accordance with the procedures disclosed in U.S. Pat. No. 4,340,559. Yarn deniers from which tensile properties are calculated, are based on yarn equilibrated to 4.5% moisture. Inherent viscosity is determined as in U.S. Pat. No. 4,340,559 as is twist multiplier (TM).

The novel yarns of this invention have improved fatigue resistance as shown by the test procedure described in detail below.

Disc Fatigue Test

The Disc Fatigue Tester cyclically compresses and extends cords that have been embedded in rubber in an effort to simulate conditions in a loaded tire when it rotates. This type of tester (U.S. Pat. No. 2,595,069), and cord-in-rubber testing procedures were developed as described in ASTM D885-591, revised 67T ASTM standards, Part 24, p. 191, October 1967.

Dipped, hot-stretched tire cords, embedded in rubber blocks, are mounted near the peripheries of two circular discs. Prior to mounting the blocks, one disc is canted with respect to the other so that the discs are closer together on one side of the tester than on the other side. Thus, as the discs rotate, cords cured in the rubber blocks alternately are compressed and extended. Cords are not flexed to the point of cord failure. After having been flexed for a specified length of time, cords are removed from the blocks and their breaking strength determined. Strength after flexing is compared with that of cords that were cured into rubber blocks, but not fatigued, and the loss in strength is calculated.

The testing conditions used in the above described procedure to establish the in-rubber fatigue resistance of cords were as follows:

| | |
|---|---|
| Cord: | 3000/1/3, TM 6.5 |
| Rubber Stock: | Du Pont stock #NR-28, Skim #635 (0.125 ± .005 thick) |
| Test Piece: | Dumbbell-shaped block, 3 in. × ½ in. × ½ in.; one cord per block |
| Curing: | 12 blocks/mold, 18 tons load at 150 ± 2° C. for 40 min. |
| Disc Settings: | Load blocks to compress or extend longitudinally Compression - 15% Extension - 0% |

-continued

| | |
|---|---|
| Fatigue Time: | 6 hours at 2700 ± 30 rpm. |

Remove cords from block after soaking in solvent, condition for 48 hours, and test for cord breaking strength as described in ASTM standards, Vol. 701, D3219-79, 1987. Percent retention of breaking strength after fatiguing is calculated as follows:

Strength Retention, percent $= {}_B A \times 100$ where

A = average breaking strength of fatigued cords

B = average breaking strength of unfatigued cords

The following examples are illustrative of this invention and are not intended as limiting:

EXAMPLE

Spinning of yarns in the following examples was substantially as described in Yang, U.S. Pat. No. 4,340,559, using Tray G thereof. The polymer in every case was poly(paraphenylene terephthalamide) (PPD-T) having an inherent viscosity of 6.3 dL/g. It was dissolved in 100.1% sulfuric acid to form dopes containing from 17 to 20 wgt.% of polymer (based on total weight of the dope). After deaeration of each dope, it was spun through a multiple-orifice spinneret of which each of the identical spinning capillaries had a diameter of 2.5 mil (0.0635 mm). Spinning was at a dope temperature of 71° C. directly into an air gap 0.64 cm in length and thence into a spin tube together with coagulating liquid which was an aqueous solution containing 8% by wt. $H_2SO_4$. In the air gap, the yarn was attenuated. In the TABLE, the attenuation factor is the ratio of speed at which coagulated yarn was forwarded to speed at which dope passed through each spinning capillary. The coagulated yarn was then forwarded to a water-washing stage, to a neutralization stage, to drying on a pair of internally steam-heated rolls with surface temperature of 150° C., and then to windup on bobbins at a moisture content of about 12 wt.%. Yarn tensions during washing/neutralization were constant and were measured just prior to each stage. Drying tension was also measured just prior to wrapping onto the dryer rolls. Fluctuations in roll speed caused slight variations in tension as shown by the ranges in the TABLE. Process conditions unique to each test are shown in the TABLE below. The results reported do not include all runs in accordance with the invention but are believed to be representative. In some runs, particularly early ones, the results obtained were not consistent, probably because of absence of adequate controls.

TABLE

| | EXAMPLES | | | | COMPARATIVE EXAMPLES | | |
|---|---|---|---|---|---|---|---|
| | 1-A | 1-B | 1-C | 1-F | 1-G | 1-D | 1-E |
| PROCESS CONDITIONS: | | | | | | | |
| % Polymer in dope | 19.4 | 18.2 | 17.3 | 19.4 | 19.4 | 19.4 | 19.4 |
| Attenuation factor | 6.3 | 5.9 | 5.6 | 6.3 | 6.3 | 6.3 | 4.2 |
| Coagulation temp., °C. | 20 | 20 | 20 | 20 | 20 | 3 | 3 |
| Wash tension, g/den | 0.2 to 0.4 | → | → | → | → | 0.6 | → |
| (g/dtex) | (0.18 to 0.36) | → | → | → | → | (0.54) | → |
| Drying tension, g/den | 0.05 to 0.2 | → | → | → | → | 0.5 to 0.6 | |
| (g/dtex) | (0.045 to 0.18) | → | → | → | → | (0.45 to 0.54) | |
| Yarn speed, yd/min | 300 | 300 | 300 | 500 | 650 | 300 | 425 |
| (m/min) | (274.3) | (274.3) | (274.3) | | | (274.3) | (388.6) |
| YARN PROPERTIES: | | | | | | | |
| Denier | 3005 | 2957 | 2972 | 2953 | 2948 | 2974 | 3000 |
| (dtex) | (3339) | (3286) | (3302) | | | (3304) | (3333) |
| Denier per filament | 1.5 | 1.5 | 1.5 | 1.5 | 1.5 | 1.5 | 2.25 |
| (dtex/filament) | (1.67) | (1.67) | (1.67) | | | (1.67) | (2.50) |
| Tenacity, g/den | 23.9 | 22.2 | 18.2 | 22.8 | 22.1 | 25.9 | 23.3 |
| (dN/tex) | (21.1) | (19.6) | (16.1) | | | (22.9) | (20.6) |
| Elongation at break, % | 5.13 | 5.45 | 5.50 | 4.90 | 4.90 | 4.21 | 4.07 |
| Modulus, g/den | 381 | 338 | 289 | 380 | 370 | 617 | 535 |
| (dN/tex) | (336.7) | (298.7) | (255.4) | | | (545.3) | (472.8) |
| DIPPED CORD (3000/1/3, TM 6.5): | | | | | | | |
| Denier | 9702 | 9551 | 9587 | 9440 | 9430 | 9587 | 9595 |
| (dtex) | (10780) | (10612) | (10652) | | | (10652) | (10661) |
| Break strength,lb. | 425.1 | 394.3 | 342.6 | 370.0 | 367.0 | 423.4 | 395.0 |
| (kg) | (193.0) | (179.0) | (155.5) | | | (192.2) | (179.3) |
| Tenacity, g/den | 19.9 | 18.7 | 16.2 | 17.8 | 17.7 | 20.0 | 18.7 |
| (dN/tex) | (17.6) | (16.5) | (14.3) | | | (17.7) | (16.5) |
| Elongation at break, % | 6.24 | 6.57 | 6.61 | 5.70 | 5.70 | 5.34 | 5.10 |
| Modulus, g/den | 254 | 228 | 198 | 240 | 245 | 287 | 299 |
| (dN/tex) | (224.5) | (201.5) | (175.0) | | | (253.7) | (264.3) |
| ACS, Angstroms | 47 | 45 | 43 | 42 | 47 | 46 | 47 |
| OA, degrees | 20.4 | 22.6 | 23.8 | 21.4 | 20.1 | 14.4 | 16.0 |
| FATIGUE RESISTANCE: | | | | | | | |
| Retained strength, lb | 256.7 | 234.9 | 194.5 | 206.0 | 184.0 | 139.0 | 154.7 |
| (kg) | (116.5) | (106.6) | (88.3) | | | (63.1) | (70.2) |
| % Strength ret.* | 60.4 | 59.6 | 56.8 | 55.7 | 50.1 | 32.8 | 39.2 |

(*Based on dipped cord strength)

In the TABLE, Example 1-A of the invention is most directly comparable with Comparative Example 1-D in that the yarns were prepared identically except for temperature of the quench bath and lower tensions employed during washing and drying. Examples 1-A to 1-C differ processwise only in that polymer concentration in the dope was decreased progressively, which required a change in attenuation ratio in order to maintain substantially constant deniers (dtex's). Examples 1-F and 1-G show higher spinning speed than Examples 1-A to 1-C. Comparative Example 1-E is different from all the others in that the den/filament (dtex/filament) value is increased, which also changes the number of filaments in the yarn. It is of interest herein principally as another type of yarn commonly used in reinforcing rubber, e.g., in tires.

From the TABLE, it is apparent that Examples 1-A to 1-C, 1-F and 1-G (of the invention) have much better fatigue resistance than do the comparative Examples 1-D and 1-E. For these test yarns, the combination of ACS and OA is unique. Where such reduced ACS is shown, however, the OA is usually lower, as shown by the Comparative Examples. Also the dipped cords of yarns of the invention have tenacities substantially the same as those of the Comparison. This is surprising when it is recognized that tenacities of the yarns of the invention are distinctly lower than for the comparison. Cord conversion efficiency is a distinct advantage of the invention. Moduli of the yarns of the invention are seen to be lower than the Comparative Examples, but the difference is less discernible on comparing the dipped cords. The present invention is particularly useful where yarns of PPD-T provide a higher modulus than is really necessary, but a lower fatigue resistance than is desired.

We claim:

1. A method for preparing poly(p-phenylene terephthalamide) yarn of improved fatigue resistance comprising the steps of:

(a) spinning a spin dope containing from 17 to 20% by wt. of said polymer in 98 to 102% sulfuric acid through an air gap into an aqueous coagulating bath to produce a coagulated yarn;

(b) maintaining the coagulating bath at a temperature of at least about 20° C.;

(c) washing and neutralizing the yarn while it is under a tension of from 0.2 to 0.4 grams per denier; and (d) drying the yarn at a temperature below 200° C. while it is maintained under a tension of 0.05 to 0.2 grams per denier.

2. A method according to claim 1 wherein the temperature of the coagulating bath does not exceed 40° C.

3. A method according to claim 1 wherein the drying temperature is 100° to 200° C.

* * * * *